United States Patent [19]

Miyauchi et al.

[11] Patent Number: 4,506,500

[45] Date of Patent: Mar. 26, 1985

[54] STEEL CORD FOR REINFORCING A RUBBER STRUCTURE

[75] Inventors: Toshiaki Miyauchi, Taka; Osamu Yoneda, Miki, both of Japan

[73] Assignee: Tokusen Kogyo Kabushiki Kaisha, Ono, Japan

[21] Appl. No.: 482,976

[22] Filed: Apr. 7, 1983

[30] Foreign Application Priority Data

| | | | |
|---|---|---|---|
| Apr. 10, 1982 | [JP] | Japan | 57-60040 |
| Apr. 30, 1982 | [JP] | Japan | 57-73544 |
| Apr. 30, 1982 | [JP] | Japan | 57-73545 |

[51] Int. Cl.[3] ..... D07B 1/06; D07B 1/10

[52] U.S. Cl. ..... 57/212; 57/218; 57/219; 57/902

[58] Field of Search ..... 57/236, 237, 3, 6, 9, 57/212, 214, 213, 215, 218, 219, 902; 152/359

[56] References Cited

U.S. PATENT DOCUMENTS

| | | | |
|---|---|---|---|
| 2,359,090 | 9/1944 | Dyer | 57/212 X |
| 2,492,352 | 12/1949 | Bourdon | 57/902 X |
| 2,598,033 | 5/1952 | Bourbon | 57/212 |
| 3,455,100 | 7/1969 | Sidles et al. | 57/902 X |
| 3,538,702 | 11/1970 | Wolf et al. | 57/902 X |
| 3,911,662 | 10/1975 | Fenner | 152/359 X |
| 4,022,009 | 5/1977 | van Assendelft | 57/212 |
| 4,030,248 | 6/1977 | van Assendelft | 57/902 X |
| 4,176,513 | 12/1979 | Young et al. | 57/237 |
| 4,349,063 | 9/1982 | Kikuchi et al. | 57/902 X |
| 4,430,851 | 2/1984 | Sundet | 57/236 X |

FOREIGN PATENT DOCUMENTS

| | | | |
|---|---|---|---|
| 48-17462 | 2/1973 | Japan . | |
| 52-5357 | 1/1977 | Japan . | |
| 55-136534 | 10/1980 | Japan . | |
| 57-193253 | 11/1982 | Japan . | |
| 2080845 | 2/1982 | United Kingdom | 57/213 |

*Primary Examiner*—Donald Watkins

*Attorney, Agent, or Firm*—Wenderoth, Lind & Ponack

[57] ABSTRACT

A steel cord having a basic construction constituted by a group of at least two wires of the same diameter twisted together and a single wire or a bundle of a plurality of parallel wires are intertwisted. This steel cord provides better adhesion between a rubber compound and the steel cord because of better infiltration of the rubber compound into a central cavity formed by adjoining steel cords and also better elastic force in the lengthwise direction of the cord.

5 Claims, 20 Drawing Figures

STEEL CORD FOR REINFORCING A RUBBER STRUCTURE

This invention relates to a steel cord for use as reinforcement for tires, conveyor belts, etc.

Generally, this kind of steel cord is made by intertwisting a plurality of wires into a strand and then by intertwisting a plurality of such strands. A plurality of steel cords thus made are arranged in parallel and covered with a rubber compound and serve as reinforcement for tires, conveyor belts, etc. Indispensable requirements when such steel cords are used as reinforcement of a rubber structure are (1) good chemical adhesion of steel cords to the rubber compound, (2) good penetration of the rubber compound into a central cavity formed by adjoining steel cords and (3) elasticity the lengthwise direction of the steel cords embedded in the rubber compound. In other words, in order to enable a steel cord to perform its duties as reinforcement of a rubber structure, it is required that the steel cords and the rubber compound be formed into a perfectly integrated substance.

In the case where steel cords are used for tires, for example, poor adhesion of the steel cords and the rubber compound and unsatisfactory penetration of the rubber compound into a central cavity formed by adjoining steel cords causes separation of the steel cords from the rubber compound or the so-called "separation phenomenon" during the running of a car, with a resultant reduction of the function of the tires. Besides, wires of steel get rusty due to moisture contained in the rubber compound, with the result being the deterioration of cord strength to a large extent and earlier occurrence of the above-mentioned "separation phenomenon".

Furthermore, low elasticity of the steel cords causes a defect that when the tire of a car runs onto a stone on a road surface, for example, the steel cord cannot follow the elastic deformation of the rubber compound which is a highly elastic material in itself and as a result the steel cord breaks.

Figure 1:
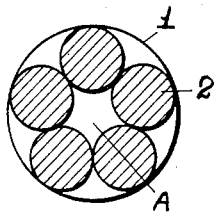
Fig. 1 (A) (PRIOR ART)
Figure 1:
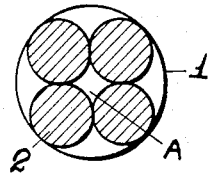
Fig. 1 (B) (PRIOR ART)
Figure 1:
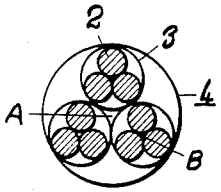
Fig. 1 (C) (PRIOR ART)
Figure 1:
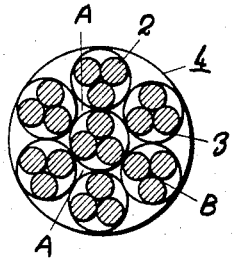
Fig. 1 (D) (PRIOR ART)
Figure 1:
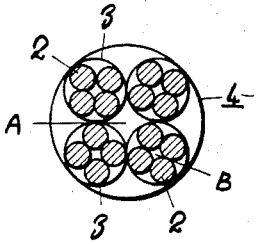
Fig. 1 (E) (PRIOR ART)
Figure 1:
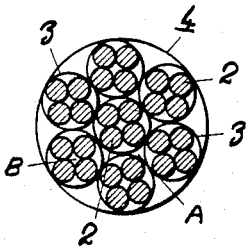
Fig. 1 (F) (PRIOR ART)

A conventional steel cord 1, as shown in FIGS. 1(A) and 1(B), is made by intertwisting a plurality of wires 2 or as shown by FIGS. 1(C), 1(D), 1(E) and 1(F), a conventional steel cord 4 is made by forming a strand 3 by intertwisting a plurality of wires and then by intertwisting a plurality of strands 3.

In the case of the above-described steel cords 1 and 4, the wires 2 stick fast to each other and strands 3 stick fast to each other. In such a state, when the steel cord 1 or the steel cord 4 is covered with a rubber compound, the rubber compound does not penetrate into central cavities formed by adjoining wires and by adjoining strands, space A and space B respectively being left unfilled with a rubber compound. Non-penetration of the rubber compound into the central cavities of the steel cords 1 and 4 does not ensure covering of material wires 2 with a rubber compound in their whole circumference, namely, perfect adhesion between the steel cord and the rubber compound cannot be achieved. Moreover, conventional steel cords 1 and 4 do not have very satisfactory elasticity.

The present invention is intended to eliminate the above-described defects of the conventional steel cord and provides a steel cord having a basic construction in which a group of wires formed by intertwisting at least two wires of the same diameter and a single wire or a bundle of wires formed by arranging a plurality of wires in a parallel state are intertwisted. The main object of the present invention is to provide better adhesion between the steel cord and the rubber compound by allowing the rubber compound to penetrate into a central cavity of the steel cord and to impart elasticity the lengthwise direction to the steel cord. Preferably, the diameter of the wire to be used for the present invention is in the range of 0.15 mm to 0.50 mm. Also, in order to improve adhesion between the wire and the rubber compound, the wire can be plated with copper alloy or can be galvanized. Wires constituting a wire group and those constituting a wire bundle may have the same or different diameters. However, wires constituting a wire group and a single wire have different diameters. Preferably, when wires of different diameters constitute a group or a bundle, the ratio of diameters should be 1:1.2–2.0. If the ratio is smaller than 1:1.2, when a group of wires and a single wire are intertwisted, the strength of the single wire becomes much smaller than that of the group of wires, with the result that the single wire is wound around the group of wires (so-called "wrapping") and accordingly construction in the form of a strand cannot be obtained, namely, high tensile strength and good elasticity cannot be achieved. On the other hand, if the ratio is larger than 2.0, the strength of the group of wires becomes less than that of the single wire and accordingly, the group of wires is wound around the single wire (so-called "wrapping"), with the same result as described above.

Moreover, in intertwisting a group of wires or strands, either the twisting direction or the twist pitch should be different. However, more effectiveness can be achieved if the twisting direction is made the same but the twist pitch of a group of wires or strands is made less than 80% of that of a cord and the pitch length is kept within the range of 5 mm–25 mm. The reason is that when intertwisting by using a buncher type twisting machine or the like, twisting in the same direction results in good work efficiency. On the other hand, from the aspect of shape stability of the cord and infiltrability of rubber compound, the above-mentioned twist pitch produces a better effect.

A group of wires intertwisted and a single wire or a bundle of wires must be intertwisted but must not be twisted together in such a fashion that one is wound around the other (the so-called "wrapped state"), because a steel cord the "wrapped state" has very poor elasticity in the lengthwise direction.

Figure 2:
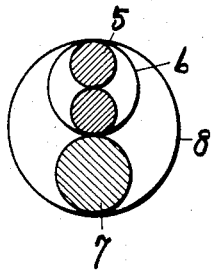
Figure 2:
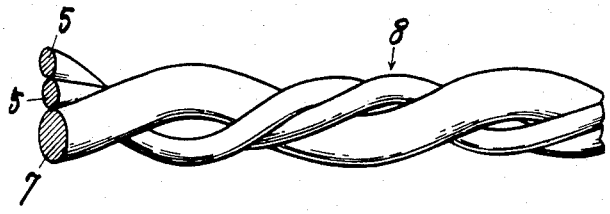
Figure 3:
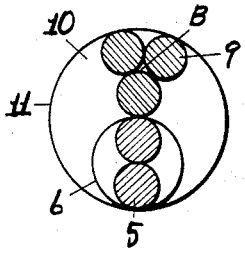
Figure 3:
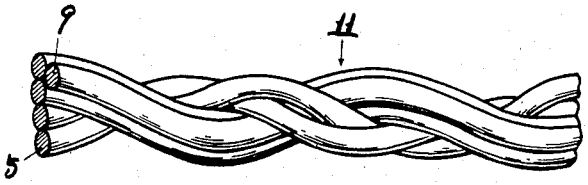
Figure 4:
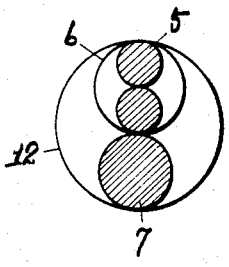
Figure 4:
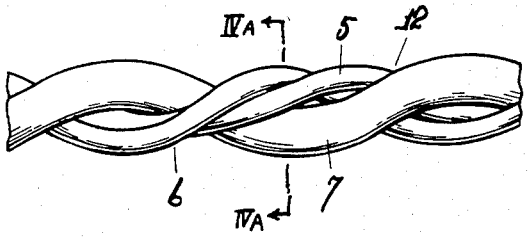
Figure 5:
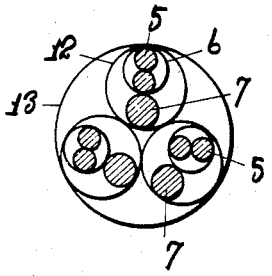
Figure 5:
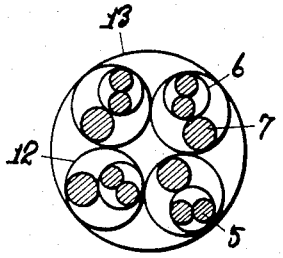
Figure 7:
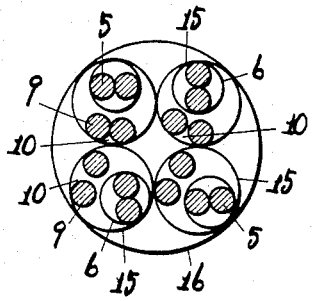
Figure 8:
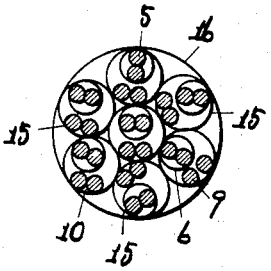
Figure 9:
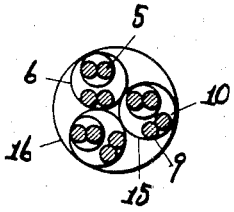
Figure 7:
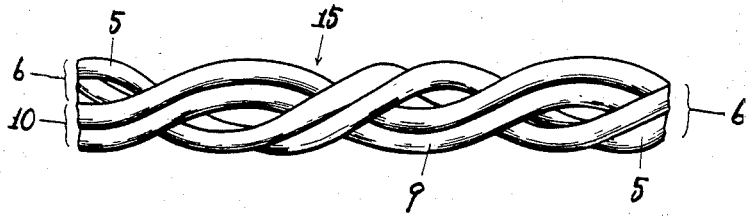

The nature and advantage of the present invention will be understood more clearly from the following description made with reference to the accompanying drawings, in which:

FIGS. 1(A), 1(B), 1(C), 1(D), 1(E) and 1(F) are cross sectional views of a conventional steel cord;

FIGS. 2(A) and 2(B) are a cross-sectional view and a side elevation view, respectively, of a steel cord of a first embodiment of the cord according to the invention;

FIGS. 3(A) and 3(B) are respectively a cross sectional view and a side elevation view of a steel cord of a second embodiment of the cord according to the invention;

FIGS. 4(A) and 4(B) are respectively a cross sectional view and a side elevation view of a strans for a steel cord of a third embodiment of the cord according to the invention;

FIGS. 5(A) and 5(B) are cross-sectional views of two embodiments of the steel cord of the invention made with the strand of FIGS. 4(A) and 4(B);

FIGS. 6(A) and 6(B) are cross-sectional views of two further embodiments of the steel cord of the invention made at least in part with the strans of FIGS. 4(A) and 4(B);

FIGS. 7(A) and 7(B) are respectively a cross sectional view and an elevation view of a steel cord according to a still further embodiment; and FIG. 8 and FIG. 9 are respectively cross-sectional views slightly different embodiments of the steel cord of the invention.

EMBODIMENT 1

In FIGS. 2(A) and 2(B), numeral 5 denotes a wire 0.25 mm in diameter. Two wires 5 are intertwisted, at a twist pitch of 5 mm and with an S twist, into a group of wires 6, which is further intertwisted with a single wire 7 which is 0.40 mm in diameter, at a twist pitch of 10 mm and with an S twist, into a steel cord 8.

The following Table 1 gives a comparison of the physical properties of the steel cord 8 according to the present invention and a conventional steel cord shown in FIG. 1(A), namely, a steel cord of 1×5×0.25, a twist pitch 10 mm and with an S twist.

TABLE 1

| Physical property | Conventional steel cord | Steel cord according to the present invention |
|---|---|---|
| Twisting construction | 1 × 5 × 0.25 | 1 × 2 + 1 |
| Twist pitch | 10 mm | 5 mm, 10 mm |
| Dia. of material wire | 0.25 mmϕ | 0.25 mmϕ, 0.40 mmϕ |
| Penetrating rate of rubber compound | 2–5% | 100% |
| Comparison of fatigue (3-point pulley system) | 100 (standard) | 130 |
| Elongation at break | 2.53 | 2.7 |

EMBODIMENT 2

A steel cord of another embodiment is shown in FIGS. 3(A) and 3(B). Numeral 5 designates a wire 0.25 mm in diameter. Two wires 5 are intertwisted, at twist pitch of 5 mm and with an S twist, into a group of wires 6, which are further intertwisted with a bundle 10 of wires 9 (not intertwisted) 0.25 mm in diameter, at a twist pitch 10 mm and S twist, into a steel cord 11.

Table 2 shows a comparison of the physical properties of the steel cord according to the present invention with a conventional steel cord.

TABLE 2

| Physical property | Conventional steel cord | Steel cord according to the present invention |
|---|---|---|
| Twisting construction | 1 × 5 | 1 × 2 + 3 |
| Twist pitch | 10 mm | 5 mm, 10 mm |
| Diameter of material wire | 0.25 mmϕ | 0.25 mmϕ |
| Penetrating rate of rubber compound | 2–5% | 100% |
| Comparison of fatigue (3-point pulley system) | 100 (standard) | 135 |
| Elongation at break | 2.53 | 2.96 |

As is obvious from the above table, the steel cord of Embodiment 2 produces almost the same result as Embodiment 1.

In Embodiment 2, space B is formed as shown in FIG. 3(A) due to wires 9 not being intertwisted. The rubber compound penetrates into this space easily.

EMBODIMENT 3

As is shown in FIG. 4(A) and FIG. 4(B), two wires 5 are intertwisted at a twist pitch of 6.5 mm and with an S twist, into a group of wires 6, which is further intertwisted with a single wire 7 0.25 mm in diameter, at a twist pitch of 13.0 mm and with an S twist, into a strand 12. As shown in FIG. 5(A) and FIG. 5(B), three or four of these strands 12 are intertwisted, at a twist pitch of 13.0 mm and with a Z twist, into a steel cord 13.

Table 3 shows a comparison of the physical properties of the steel cord according to a present invention (the above-described steel cord) and a conventional steel cord having the cross-sectional shape shown in FIG. 1(C).

TABLE 3

| Item | Conventional steel cord | Steel cord according to the present invention |
|---|---|---|
| Twisting construction | 3 × 3 | 3 × (1 × 2 + 1) |
| Twisting direction | S twist/S twist | S twist/S twist/ Z twist |
| Twist pitch (mm) | 13.0/13.0 | 6.5/13.0/13.0 |
| Dia. of material wire (mm) | 0.20ϕ | 0.175ϕ/0.25ϕ |
| Penetrating rate of rubber compound (%) | 6–9 | 100 |
| Comparison of fatigue (3-point pulley system) | 100 (standard) | 135 |
| Cord strength (Kg) | 66 | 67 |
| Elongation at break (%) | 2.7 | 6.0 |

In Embodiment 3, the ratio of the diameters of the two wires 5 constituting the strand 6 and the single wire 7 which is intertwisted with the strand 6 should preferably be 1:1.2–2.0. If the diameter of the single wire 7 is smaller than 1.2 times the diameter of the wires 5, when the group of wires 5 and the single wire 7 are intertwisted, the strength of the single wire becomes much smaller than that of the group of wires and is wound around the group of wires (so-called "wrapping"), with the result of poor construction of strand 12 and poor tensile strength and elasticity. On the contrary, if the diameter of single wire 7 is larger than 2.0 times the diameter of the group of wires, the strength of the group of wires becomes less than that of the single wire 7 and the group of wires is wound around the single wire 7 (so-called "wrapping"), causing such defects as poor tensile strength and poor elasticity.

EMBODIMENT 4

Figure 6:
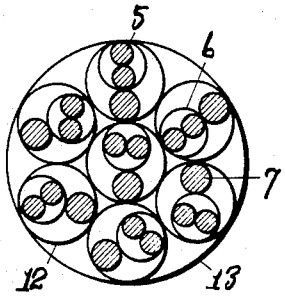
Figure 6:
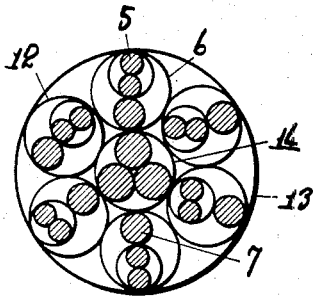

As shown in FIG. 6, seven strands 12 formed in the same way as the strand of Embodiment 1 are intertwisted, at a twist pitch 13.0 mm and with a Z twist, into a steel cord 13.

Comparison of physical properties was carried out in the same way as for Table 3 are shown in the following Table 4.

TABLE 4

| Item | Conventional steel cord | Steel cord according to the present invention |
|---|---|---|
| Twisting construction | 7 × 3 | 7 × (1 × 2 + 1) |
| Twisting direction | S twist/Z twist | S twist/S twist/ Z twist |
| Twist pitch (mm) | 13.0/13.0 | 6.5/13.0/13.0 |
| Dia. of material wire (mm) | 0.20ϕ | 0.175ϕ/0.25ϕ |
| Penetrating rate of rubber compound (%) | 100 (standard) | 133 |

TABLE 4-continued

| Item | Conventional steel cord | Steel cord according to the present invention |
|---|---|---|
| Cord strength (Ig) | 155 | 160 |
| Elongation at break (%) | 2.8 | 6.2 |

In Embodiment 4, each of the strands 12 which constitute a steel cord comprises a group of wires 6 and a single wire, but the present invention is not limited to such construction. It is possible to constitute a steel cord 13, as shown in FIG. 6(B), by using a core strand 14 (normal 1×3 construction) and side strands 12 having the above-described construction.

EMBODIMENT 5

As shown in FIG. 7, a group of wires 6 is formed by intertwisting two wires 5 with a 0.175 mm diameter at a twist pitch 6.5 mm and with an S twist. A bundle of wires 10 is formed by arranging in parallel two wires 9 having the same diameter as the wire 5. The group of wires 6 and the bundle of wires 9 are intertwisted, at a twist pitch 13.0 mm and with an S twist, into a strand 15 as shown in FIG. 7(B). Four of these strands 15 are intertwisted, at a twist pitch 13.0 mm and with a Z twist, into a steel cord 16.

A comparison of physical properties of the above-described steel cord comprising four strands with the conventional steel cord having the cross-sectional shape shown in FIG. 1(E) is indicated in the following Table 5.

TABLE 5

| Item | Conventional steel cord | Steel cord according to the present invention |
|---|---|---|
| Twisting construction | 4 × 4 | 4 × (1 × 2 + 2) |
| Twisting direction | S twist/Z twist | S twist/S/twist/ Z twist |
| Twist pitch (mm) | 13.0/13.0 | 6.5/13.0/13.0 |
| Dia. of material wire (mm) | 0.175ϕ | 0.175ϕ |
| Penetrating rate of rubber compound (%) | 4–7 | 85–95 |
| Comparison of fatigue (3-point pulley system) | 100 (standard) | 130 |
| Cord strength (Kg) | 98 | 97 |
| Elongation at break (%) | 2.8 | 6.1 |

EMBODIMENT 6

As shown by in FIG. 8, seven strands 15 formed in the same way in Embodiment 5 are intertwisted, at a twist pitch 13.0 mm and with a Z twist, into a steel cord 16.

Comparison of physical properties of the steel cord of the embodiment with the conventional steel cord is shown in the following table 6.

TABLE 6

| Item | Conventional steel cord | Steel cord according to the present invention |
|---|---|---|
| Twisting construction | 7 × 4 | 7 × (1 × 2 + 2) |
| Twisting direction | S twist/Z twist | S twist/S twist/ Z twist |
| Twist pitch (mm) | 13.0/13.0 | 6.5/13.0/13.0 |
| Dia. of material wire (mm) | 0.175ϕ | 0.175ϕ |
| Penetrating rate of rubber compound (%) | 2–5 | 80–95 |
| Comparison of fatigue (3-point pulley system) | 100 (standard) | 140 |
| Cord strength (Ig) | 170 | 169 |
| Elongation at break (%) | 2.7 | 6.0 |

In this embodiment, each of the strands 15 which constitute a steel cord was formed by a group of wires 6 and a bundle of wires 10, but the present invention is not limited to such formation and it is possible to construct a steel cord by using a core strand of ordinary 1×4 construction and side strands of normal 1×4 construction.

FIG. 9 shows a cross section of a steel cord of further embodiment. This steel cord 16 is composed by intertwisting three strands 15. The steel cord of this embodiment produces the same result as Embodiments 5 and 6.

An explanation is given below of the method of producing a steel cord by using a buncher type twisting machine.

In the case where steel cords of Embodiments 3 and 4 are produced, two wires are introduced from one side of the axis of a flyer of a buncher type twisting machine. These wires are twisted together as they are turning the circumference of the cradle and are introduced into the cradle from the other side of the axis. At the same time, a single wire is introduced from the other side of the axis and is introduced directly into the cradle. Since a group of two wires twisted together in the above way and the single material wire are introduced into the cradle from the axis of the flyer at the same time, both are twisted together in the same direction as the wire group but at a twist pitch twice that of the wire group, into a strand. A plurality of strands thus produced are intertwisted into a steel cord. The use of a buncher type twisting machine provides a very high working efficiency and produces strands and steel cords with a stabilized twist construction. Use of a cylindrical type twisting machine in combination with a buncher type twisting machine is possible.

In the case where steel cords of Embodiments 5 and 6 are produced, two wires each are introduced from opposite sides of the axis of the flyer of the buncher type twisting machine. Wires introduced from one side of the axis are twisted together as they are turning the circumference of the cradle and are introduced into the cradle from the other side of the axis. At the same time, wires introduced from the other side of the axis are introduced directly into the cradle without being twisted. A group of two wires twisted together in the above way and a bundle of two wires untwisted are introduced at the same time from the axis of the flyer into the cradle and therefore both are intertwisted in the same twist direction as the group of wires but at a twist pitch twice that of the group of wires and are formed into a strand. A plurality of strands thus formed are intertwisted by a buncher type twisting machine into the desired steel cord.

As described above, the steel cord according to the present invention is quite different in twist construction from the conventional steel cord. Moreover, since the steel cord according to the present invention provides good infiltration of the rubber compound, when it is covered with a rubber compound and is used as reinforcement for rubber structures, it forms a perfectly integrated material of steel cords and a rubber compound, displaying a 100% function as a steel cord. Since the steel cord according to the present invention does not rust due to moisture content of the rubber, the strength of the steel cords is be maintained for a long period of time. Moreover, since it has excellent elasticity, it follows the elastic deformation of the rubber compound well, fulfilling the function as reinforcement, and also does not break easily.

What is claimed is:

1. A steel cord for use as reinforcement for rubber structures, comprising a group of at least two wires of the same diameter intertwisted with each other, and a single wire intertwisted with said group, at least one of the twist direction and the twist pitch of the wires in said wire group being different from the corresponding twist direction and twist pitch of the single wire and wire group constituting said steel cord.

2. A steel cord for use as reinforcement for rubber structures, comprising a group of at least two wires of the same diameter intertwisted with each other, and a bundle of at least two untwisted wires of the same diameter intertwisted with said group, at least one of the twist direction and the twist pitch of the wires in said wire group being different from the corresponding twist direction and twist pitch of the bundle of wires and wire group constituting said steel cord.

3. A steel cord for use as reinforcement for rubber structures, comprising a plurality of intertwisted strands, each strand being constituted by two wires intertwisted with each other and in turn intertwisted with a single wire having a different diameter from the diameters of said two wires.

4. A steel cord as claimed in claim 3 wherein the diameter of said single wire is in the range of from 1.2 to 2.0 times the diameter of said two wires.

5. A steel cord for use as reinforcement for rubber structures, comprising a plurality of intertwisted strands, each strand being constituted by two wires intertwisted with each other and a bundle of at least two wires extending in parallel to each other.

* * * * *